US006626808B1

(12) United States Patent
Adams

(10) Patent No.: US 6,626,808 B1
(45) Date of Patent: Sep. 30, 2003

(54) EXERCISE DEVICE AND METHOD OF USING SAME

(76) Inventor: Cleveophis Adams, 117 Rosebay Dr., No. 22, Encinitas, CA (US) 92024

( * ) Notice: Subject to any disclaimer, the term of this patent is extended or adjusted under 35 U.S.C. 154(b) by 0 days.

(21) Appl. No.: 09/015,603

(22) Filed: Jan. 30, 1998

(51) Int. Cl.[7] ..... A63B 21/00
(52) U.S. Cl. ..... 482/140; 482/111; 482/124
(58) Field of Search ..... 482/121, 124, 482/130, 112, 128, 139, 908, 140

(56) References Cited

U.S. PATENT DOCUMENTS 4,645,197 A * 2/1987 McFee ..... 482/112
5,046,726 A * 9/1991 Van Straaten ..... 482/128
5,071,119 A * 12/1991 Johnson ..... 482/112
5,160,304 A * 11/1992 Van Der Hoeven ..... 482/121
5,232,425 A * 8/1993 Miller et al. ..... 482/140
5,695,436 A * 12/1997 Huang ..... 482/121
5,776,039 A * 7/1998 Perez, Jr. ..... 482/121

* cited by examiner

*Primary Examiner*—Jerome W. Donnelly

(57) ABSTRACT

An inventive exercise device is disclosed for facilitating the strengthening of abdominal and back muscles, and includes a resistance member coupled between a lap engageable base and an arm positioning member. The arm positioning member helps to maintain the back of the user in a substantially upright position as the arm positioning member applies and releases reciprocatively and alternatingly in a substantially vertical path of travel of the upper body of the user against the force on the resistance member during repetitions of use of the device. The resistance member resists substantially vertical downward movement relative to the base member to enhance the development of muscle strength by enabling the upper body of the user to contract and expand reciprocatively vertically without leaning forwardly in a safe and effective manner.

15 Claims, 1 Drawing Sheet

EXERCISE DEVICE AND METHOD OF USING SAME

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Technical Field

The present invention relates in general to an exercise device and a novel method of using it. The invention more particularly relates to a device for exercising the abdominal and lower back muscles while reducing the risk of muscle injury according to a novel method.

2. Background Art

There are many types of exercise devices for exercising the abdominal and lower back muscles of a user. For example, reference may be made to the following U.S. Pat. Nos. 5,005,832; 5,071,119; 5,171,201; 5,224,914; 5,441,473; 5,492,524; and 5,588,941.

In general, the exercise devices disclosed in the aforementioned U.S. patents facilitated the performance of an abdominal or stomach "crunch" exercise. The crunch exercise is performed by bending at the waist, wherein the abdominal and lower back muscles are contracted to bring the upper torso toward the thighs. The abdominal and lower back muscles are subsequently relaxed slowly to enable the upper torso to return to its starting position. By repeating the exercise for a number of repetitions, the strength of the abdominal and lower back muscles can be significantly increased.

U.S. Pat. No. 5,071,119 described an abdominal exercise device for a user sitting in a chair. The device included a spring loaded piston having a push bar supported at one end. In use, the piston engaged a ground surface in front of the seated user, and the arms of the user were brought up to engage the push bar. Starting from an upright position, the body of the user was bent at the waist while contracting the abdominal and lower back muscles to bring the upper torso of the user forwardly toward the thighs of the user. The piston resisted the forward bending movement of the torso, causing the muscles to exert an even greater amount of energy than would otherwise be required to perform the abdominal crunch. As a result, the abdominal and lower back muscles worked harder to complete the crunch, and the muscles were strengthened and conditioned accordingly.

U.S. Pat. No. 5,224,914 disclosed an abdominal exercise device for a seated user including a leg engaging member, a chest engaging member, resilient spring members coupled between the leg engaging member and the chest engaging member, and a pair of hand engaging members extending rearwardly from the chest engaging members. The exercise device was positioned on the seated user with the leg engaging member resting on the thighs of the user, and the chest engaging member abutting the chest of the user. The user grasped the hand engaging members to maintain the arms of the user against the upper torso of the user, and to maintain the hands of the user adjacent to the chest. Subsequently, the body of the user was bent forwardly at the waist while contracting the abdominal and lower back muscles to cause the chest engaging member to be brought toward the leg engaging member. The spring members resisted the movement of the chest engaging member relative to the leg engaging member to increase the effectiveness of the crunch exercise.

Although the prior known exercise devices were capable of facilitating the performance of crunch exercises to strengthen the abdominal and lower back muscles of the user, all of the prior known exercise devices suffered from the same serious drawback, in that they could inadvertently cause injury to the user. Also, such devices could aggravate or increase the extent of existing injuries to the lower back muscles. In this regard, people with injuries to the lower back muscles were susceptible to further injury by performing the standard crunch exercise. As a result, it has been advisable for people with existing muscle injuries to avoid exercising the abdominal and lower back muscles until such time that the injuries had healed, and even then such person would be susceptible to re-injury.

Therefore, it would be highly desirable to have a new and improved exercise device for exercising the abdominal and lower back muscles of a user, without performing a crunch type of exercise, in accordance with a novel method and exercise device. Such an exercise device should facilitate strengthening the abdominal and lower back muscles in a safe and convenient manner. The device should facilitate the exercising of the muscles in an effective manner, with little or no risk of injury to the user, or of re-injuring or aggravating old injuries. It would be desirable to have such a device which could be used conveniently while seated in a chair, without the need of having the user wear exercise or other leisure type clothing. Also, such a device should be compact in size and light in weight so that it can be readily transported, or stored away when not in use.

SUMMARY OF THE INVENTION

Therefore, the principal object of the present invention is to provide a new and improved exercise device for exercising abdominal and lower back muscles in a relatively safe but effective manner.

Another object of the present invention is to provide such a new and improved device and method of performing the exercises, wherein the exercise device is used in a seated position, and the device is compact in size and transportable.

Briefly, the above and further objects of the present invention are realized by providing a new and improved exercise device which can be used by a seated user to exercise the abdominal and lower back muscles according to a novel method of the present invention.

An inventive exercise device is disclosed for facilitating the strengthening of abdominal and back muscles, and includes a resistance member coupled between a lap engageable base and an arm positioning member. The arm positioning member helps to maintain the back of the user in a substantially upright position as the arm positioning member applies and releases reciprocatively and alternatingly in a substantially vertical path of travel of the upper body of the user against the force on the resistance member during repetitions of use of the device. The resistance member resists substantially vertical downward movement relative to the base member to enhance the development of muscle strength by enabling the upper body of the user to contract and expand reciprocatively vertically without leaning forwardly in a safe and effective manner.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
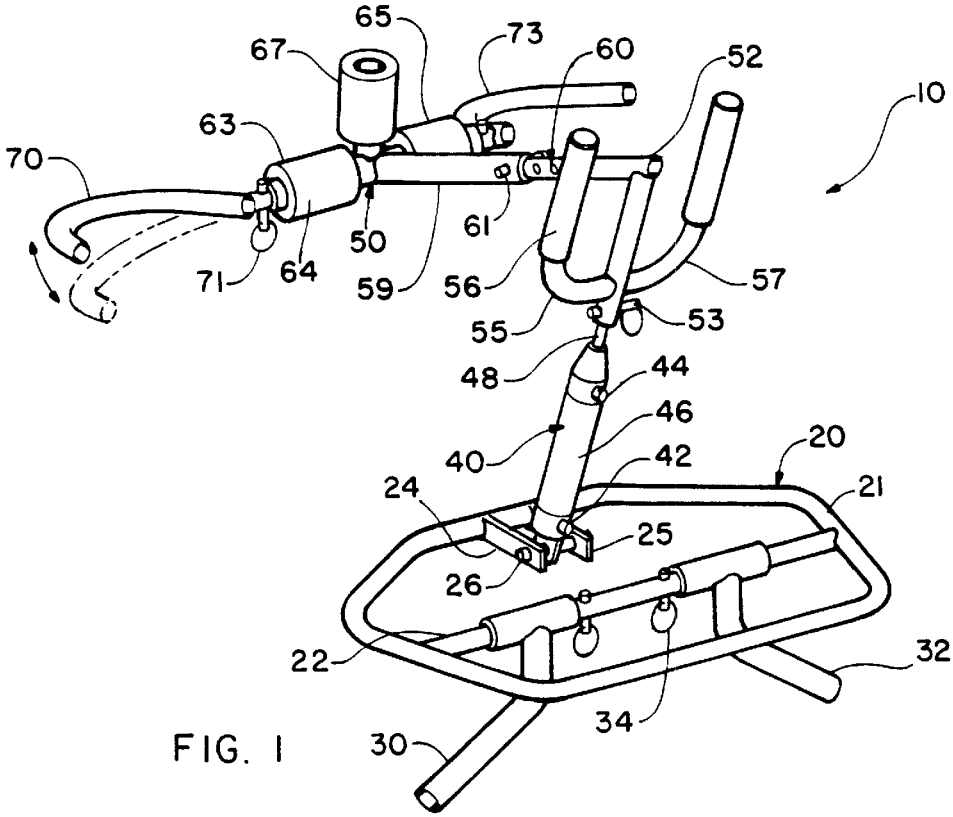
FIG. 1 is a pictorial view of an exercise device, which is constructed in accordance with the present invention.

Referring to the drawings and more particularly FIG. 1 thereof, there is shown an exercise device 10 which is constructed in accordance with the present invention. The exercise device 10 can be utilized for conditioning abdominal and lower back muscles of a user 2 while seated in a chair 4 or other suitable seat (not shown), in accordance with the method of the present invention.

The exercise device 10 generally includes a lap engaging frame or base 20 for supporting the device 10 on the lap of the user 2 while seated in the chair 4. A resistance device or member 40 is coupled at one of its ends to the lap engaging frame 20 for providing the resistance during exercising. An arm positioning member or brace 50 coupled to the resistance device 40 at another end thereof, helps to position the arms in an L-shaped configuration (FIG. 2) with the upper arm portions abutting or engaging snugly the upper torso of the user and the forearms extending forwardly away from the body of the user 2. The resistance member 40 helps to resist vertical movement of the arm positioning member 50 relative to the lap engaging frame 20 to help tone and strengthen the muscles of the user 2 in a safe and effective manner.

Figure 2:
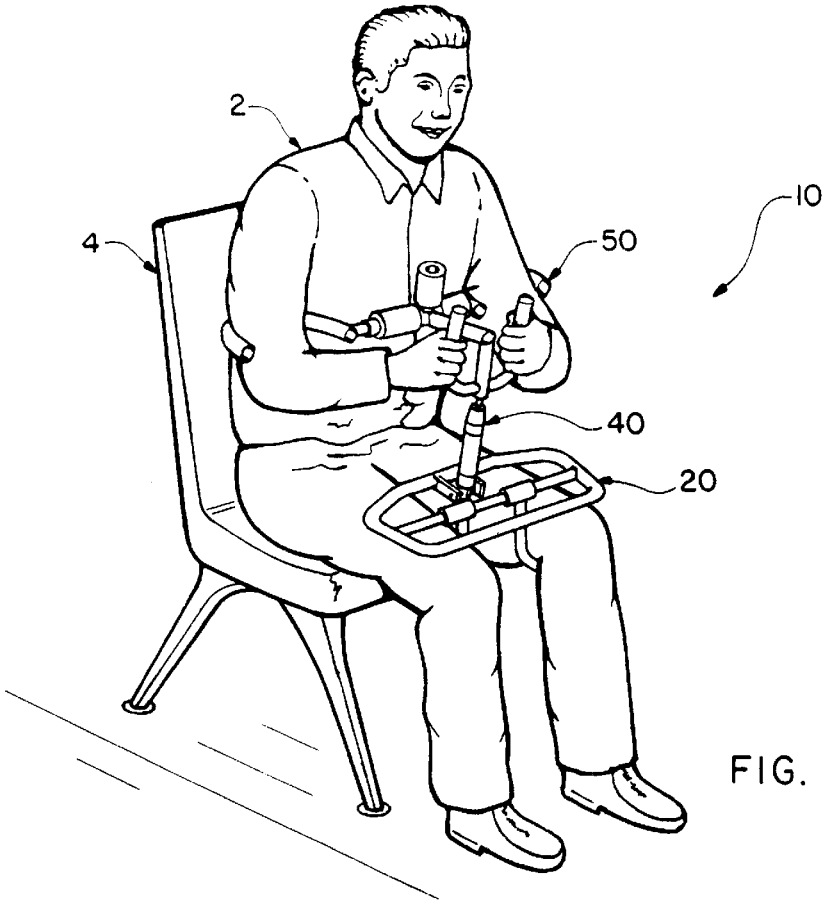
FIG. 2 is a reduced scale view of the device FIG. 1, illustrating it during use.

As best seen in FIG. 2, the exercise device 10 is adapted for use by the user 2 sitting in a substantially upright position on a chair 4. The lap engaging frame 20 is disposed in a generally horizontal position on the lap of the seated user 2 with the arm positioning member 50 arranged in a generally horizontal disposition engaging the chest of the user 2 in an initial or rest position. The upper arms and hands of the user 2 engage the arm positioning member 50 to position the arms in a generally L-shaped configuration. The inner thighs of the user 2 engage the lap engaging frame 20 and apply inwardly directed forces thereon.

In accordance with the present invention, the user 2 sits in the upright position with the abdominal and lower back muscles relaxed. Subsequently, the user contracts the abdominal and the lower back muscles directly downwardly against the force of the generally upright resistance member 40 to apply a substantially downward vertical force to the resistance member 40. The lap engaging frame 20 braces the upright resistance member 40 and resists it from moving downwardly under the force applied by the arm positioning member 50. At the same time, the resistance member 40 resists the vertical force applied by the arm positioning member 50, causing the abdominal and lower back muscles to exert additional contracting action.

The exercise is completed by relaxing the abdominal and lower back muscles while raising the arm positioning arrangement 50 relative to the lap engaging frame 20 until the arm positioning arrangement 50 returns to the initial relaxed position. This cycle of operation is then repeated as many times as desired.

During the entire exercise, the user 2 remains in the substantially upright position with the elbows adjacent to the body and the forearms at about right angles to the body, thereby reducing the risk of muscle injury to the user. The exercise can be repeated as desired to further condition the abdominal and lower back muscles. When the exercise has been completed, the exercise device 10 can be stored in a compact manner for use at a later time as hereafter described in greater detail.

In summary, in accordance with the method of the present invention, while sitting in the chair 4 with the frame 20 positioned on his or her lap, the user 2 sits in an upright position with his or her back straight. The user then contracts his or her upper body directly vertically downwardly against the force of the upright resistance member 40, without leaning forwardly in the conventional crunch movement. Thus, the back is protected from injury, since the undesirable and unwanted crunch movement is avoided, and yet the abdominal and lower back muscles are exercised in a safe and effective manner.

During the vertical downward body contracting movement by the user, the thighs press inwardly on the frame 20 to stabilize it and to maintain the upper body of the user in a generally vertical position during the repeated up and down movements of the body. Additionally, the arm positioning member 50 facilitates causing the user to press his or her arms inwardly against his or her torso to maintain the erect vertical position of the user's body during the repetitions of the exercise operation.

Thus, the repeated up and down contractions and expansions of the upper body against the resistance device 40, without leaning forwardly provides a vigorous exercise of the abdominal and lower back muscles in a safe and effective manner.

In the preferred form of the invention, the resistance device 40 provides resistance in both the upward and downward directions. Thus, during the final phase of the exercise, when the user raises the arm positioning member 50 relative to the lap engaging frame 20, the user is required to apply a sufficient upwardly directed force with the arm positioning member 50 to overcome the resistance supplied by the resistance member 40.

It will be understood by one skilled in the art that the resistance member 40 may provide resistance against movement in one direction only. For example, the resistance member 40 resists downward vertical movement only to facilitate conditioning the abdomen and lower back muscles. During the final phase of the exercise when the user is raising the arm positioning member 50 relative to the lap engaging frame 20, the resistance member 40 could provide little or no resistance.

Considering now the exercise device 10 in greater detail with reference to FIG. 1, the lap engaging frame 20 includes an annular rim member 21 adapted to rest comfortably on the lap of the user 2, and to provide stability for the exercise device 10 during an exercise routine. The rim member 21 is generally composed of a rigid material, such as aluminum tubular material. A tubular central support or cross member 22 extends between and is affixed to opposing sides of the rim member 21 to support a pair of generally outwardly curved thigh brace members 30 and 32. The thigh brace members 30 and 32 are adapted to engage and bear forcibly against the inner thighs of the user 2, and depend from and are positionable along the length of the central support member 22 to accommodate the user 2. The thigh brace members 30 and 32 are pivotable at their upper ends about the support member 22 to swing upwardly against the rim member 21 to facilitate reducing the size requirements of the device 10 for storage purposes. A pair of removable pins such as a pin 34 cooperate with openings (not shown) in the central support member 22 to limit the movement of the thigh braces 30 and 32 along the length of the support member 22 adjustably to fit a given user.

The lap engaging frame 20 further includes a pair of spaced apart support clavis brackets 24 and 25 extending inwardly from rim member 21 for helping to couple the resistance member 40 pivotally to the lap engaging frame 20. A pivot pin 26 extending through an opening (not shown) in one end of the resistance member 40, and through the support brackets 24 and 25, substantially fixes the resistance device 40 relative to the lap engaging frame 20 while permitting the resistance device 40 to pivot relative to the lap engaging frame 20 during use of the device 10.

The resistance device 40 is preferably a piston cylinder assembly and includes a cylinder 46 which receives reciprocatively a piston 48 therein. The resistance provided by the resistance member 40 against the piston 48 being urged inwardly into the cylinder 46 is controlled adjustably by an adjustment member 42 (FIG. 1). Similarly, the outwardly movement of the piston member 48 relative to the cylinder member 46 is controlled adjustably by an adjustment member 44 (FIG. 1). Other devices for resisting movement, such as compression spring devices (not shown), could also be used to provide resistance of the vertical movement of the arm positioning member 50 relative to the lap engaging frame 20.

The arm positioning member 50 includes an L-shaped support member 52 coupled to the piston member 48 of the resistance member 40 by a removable pin 53. The pin 53 can be removed to separate the arm positioning member 50 from the piston member 48 and the frame 20 when storing or transporting the device 10. A tubular member 59 receives telescopically and adjustably the end of the horizontal portion of the L-shaped support member 52 by a removable pin 61 extending through a pair of aligned holes (not shown) in the member 59 and a selected one of a pair of aligned holes such as the holes 60 (FIG. 1) in the member 52. Thus, the plurality of openings through the support member 52 cooperate with the pin 61 to enable the position of the chest engaging member 59 relative to the L-shaped support member 52 to be adjusted to suit the user 2. The chest engaging member 59 includes a pair of oppositely disposed lateral brace members 63 and 65 and a transverse brace member 67 to form a T-shaped end which receives the chest. To enhance the comfort of the user 2, the lateral brace members 63 and 65, and the transverse brace member 67, are covered with a padding material 64.

A pair of generally U-shaped hook or elbow brace members 70 and 73 are connected to respective ends of the lateral brace members 63 and 65 by an associated removable pin, such as the pin 71. The pins are removable in a manner similar to the pin 53, to permit the brace members 70 and 73 to be removed from the respective members 63 and 65 for storage and transportation purposes and render the brace members 70 and 73 adjustable in the overall distance between the members 70 and 73 to accommodate different users, depending on their size. In this regard, the members 70 and 73 engage the respective brace members 63 and 65 telescopically and axially adjustable. In so doing, the connections are also adjustable rotatably angularly so that the members, such as the member 70, can be positioned downwardly angularly as indicated in broken lines in FIG. 1. In such lower positions, the members 70 and 73 are engaged at a lower position on the arms of the user near the elbows so that the chest engageable members 63, 65 and 67 do not engage the chest of the user for the comfort of the user. The elbow brace members 70 and 73 receive the upper arms at about the elbows, and help position the upper arms against the upper torso of the user 2. Extending outwardly and upwardly from the L-shaped support member 52 are a pair of hand brace member 55 and 57. The hand brace members 55 and 57 position the hands away from the body to position the arms in an L-shape, and help to apply the substantially vertical force on the resistance member 40 by the arm positioning member 50. Hand grips, such as the hand grip 56, can be provided on the hand brace members 55 and 57 to enable the user 2 to more easily grasp the hand brace members 55 and 57.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An exercise device for a seated user, comprising:

a horizontal lap engageable base member for resting on the lap of the user sitted in an upright position;

a thigh brace arrangement conncected to said base member;

an upright resistance means pivotally connected to said base member for resisting substantially vertical movement relative to said base member; and a horizontal arm positioning means pivotally connected to the upper end of said resistance means for applying a substantially vertical force to said resistance means and for helping to maintain the back of the user in a substantially vertical upright position as said arm positioning means applies and releases said substantially vertical force to said resistance means to enable the upper body of the user to contract and expand vertically without leaning forwardly to exercise the muscles of the user in a safe and effective manner.

2. An exercise device according to claim 1, wherein said resistance means includes a piston cylinder assembly.

3. An exercise device according to claim 2, wherein said piston cylinder assembly is adjustable to vary the resistance to said substantially vertical movement.

4. An exercise device according to claim 1, wherein said arm positioning meaty includes a chest engageable member.

5. An exercise device according to claim 4, wherein said chest engageable member is generally T-shaped.

6. An exercise device according to claim 4, further including padding material disposed on said chest engageable member.

7. An exercise device according to claim 1, wherein said arm positioning means includes an elbow brace member and a hand brace member spaced apart from said elbow brace member.

8. An exercise device according to claim 1, further including pivot means for connecting said resistance means to said base member and said-arm positioning means.

9. An exercise device, comprising:

a lap engageable base member;

resistance means connected to said base member for resisting substantially vertical movement relative to said base member;

a chest engageable member connected to said resistance means and offset therefrom;

an elbow brace member connected to said chest engageable member; and a hand brace member spaced apart from said chest engageable member for cooperating with said elbow brace arrangement to apply a substantially vertical and downward force on said resistance means to enable the body of the user to contract and expand reciprocatively vertically without leaning forwardly.

10. An exercise device according to claim 9, further including a thigh engageable brace member connected to said base member.

11. An exercise device according to claim 10, wherein said chest engageable member is T-shaped.

12. An exercise device according to claim 9, wherein said elbow brace member includes a pair of oppositely disposed hook members connected to said chest engageable member.

13. An exercise device according to claim 9, wherein said hand brace member includes a pair of hand braces.

14. An exercise device according to claim 9, wherein said resistance means includes a piston cylinder assembly.

15. An exercise device according to claim 14, wherein said piston cylinder assembly is adjustable to vary the resistance to said substantially vertical movement.

* * * * *